United States Patent [19]

Ellestad

[11] 4,382,574

[45] May 10, 1983

[54] MOTOR MOUNT FOR CANOES

[76] Inventor: Everett Ellestad, Skäcklingevägen 57, S-14700 Tumba, Sweden

[21] Appl. No.: 212,258

[22] Filed: Dec. 2, 1980

[30] Foreign Application Priority Data

Dec. 7, 1979 [SE] Sweden ..... 7910086

[51] Int. Cl.[3] ..... F10M 1/00

[52] U.S. Cl. ..... 248/641; 440/900

[58] Field of Search ..... 248/641, 642, 640; 440/6, 62, 63, 900

[56] References Cited

U.S. PATENT DOCUMENTS

| | | | |
|---|---|---|---|
| 1,118,208 | 11/1914 | McLaren | 248/641 |
| 1,141,196 | 6/1915 | McLaren | 248/642 X |
| 2,042,598 | 6/1936 | Harvey | 248/642 X |
| 2,475,889 | 7/1949 | Hafele | 248/641 |
| 3,601,344 | 8/1971 | Nourse | 248/641 |
| 3,645,483 | 2/1972 | Bartosch | 248/641 |
| 3,918,666 | 11/1975 | Florian | 248/641 |

*Primary Examiner*—J. Franklin Foss

*Attorney, Agent, or Firm*—Young & Thompson

[57] ABSTRACT

A motor mount that can be affixed to the gunwales of canoes comprises a foldable framework having two side rails in the form of U-shaped extrusions or U-beams with elastic linings and two crosspieces in the form of bars or pipes. The parts of the framework are joined by means of clamping devices rotatable around vertical axes at each end of the U-shaped side rails and holding the crosspieces so that said pieces can be slid through and/or clamped tight in said clamping device. One of the cross-pieces projects beyond the framework and supports a motor mounting piece on which a propulsion motor can be mounted.

1 Claim, 4 Drawing Figures

FIG.1
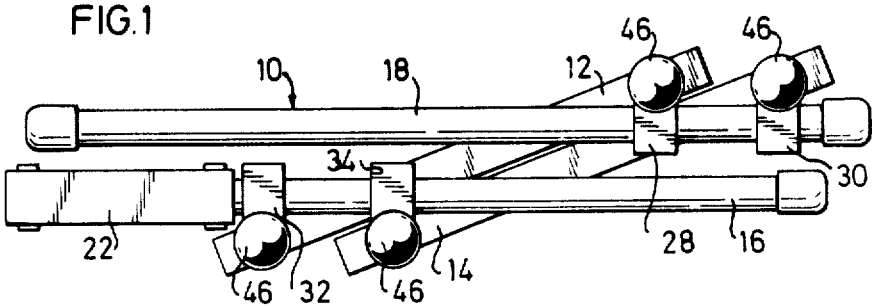
FIG. 2
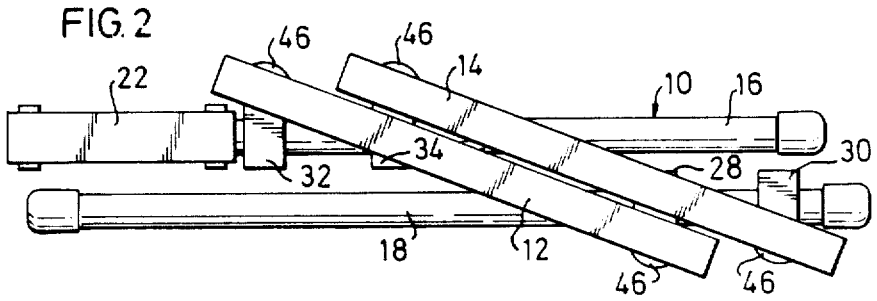
FIG. 3
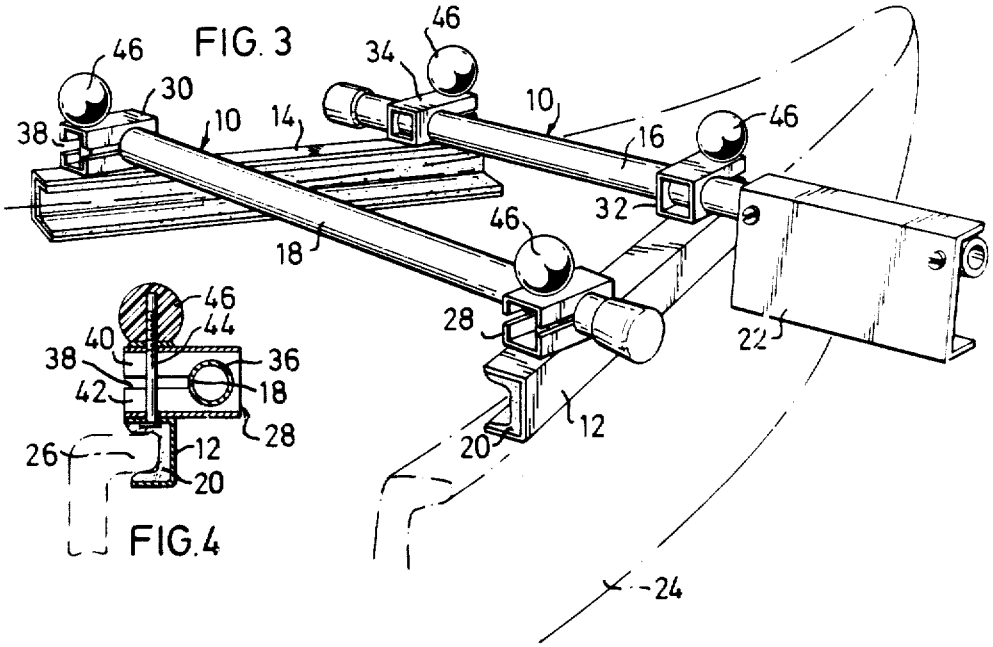
FIG.4

MOTOR MOUNT FOR CANOES

This invention relates to a motor mount for canoes. The motor mount is intended to be affixed to the outwardly projecting or inwardly projecting gunwales of canoes. Motor mounts for canoes are known that have a motor mounting piece for attaching an outboard motor with accompanying power shaft and propeller, whereby the motor mounting piece is supported by a framework comprising two side pieces, or bars, which in the affixed position are situated along the gunwales, and two crosspieces. Such motor mounts are known for example through U.S. Pat. Nos. 2,475,889, 1,118,208, 3,601,344, 3,645,483 and 3,918,666.

One of the disadvantages inherent in the design of these known motor mounts is that the frame projects beyond the stern of the canoe in order to support a motor directly sternwards. Although this placement may be advantageous per se for propulsion, it means that the positioning of the framework is fixed to a predetermined location relative to the length of the canoe. This means that such a motor mount can fit only certain canoe types, usually only one type.

A second disadvantage is that the motor's tiller handle must be relatively long to be reached from the stern seat. This in turn will result in a long swivel radius when steering with a long lever.

The known motor mounts, furthermore, are usually provided with clamping screws for clamping the frame to the gunwales, which may provide firm fastening per se but which may also result in the creation of local stresses on the relatively weak gunwales of modern canoes, that is, canoes made of fiberglass-reinforced plastic.

A further important disadvantage inherent in the design of the known motor mount is that they occupy a relatively large space when being transported, since they cannot be folded together easily. Hence, they cannot be stored in a small space in an automobile nor stowed away easily in the canoe when not in use.

The primary object of this invention is to provide a new and improved motor mount of similar type that eliminates the disadvantages of the known motor mounts.

This is accomplished by a motor mount that according to this invention has the characteristics expressed in the claim herein.

The motor mount according to this invention has, among other, the following advantages as compared with the known motor mounts.

It is very easy to fold together into a position whereby the parts lie close aganist one another, compactly, to occupy the smallest possible space, and it is just as easy to unfold in order to place and affix it to the gunwales of a canoe with the aid of the elastic-lined U-shaped side rails.

It can be variably adjusted to the hull and gunwale shapes of almost all existing canoes by swinging the side rails relatively to each other or by moving them towards or away from each other along the crosspieces, or bars, whereby the motor mount can be easily affixed at any desirable distance from the stern, within the limits imposed by the gunwales and the length of the cross bars.

It can be fastened to the outwardly or inwardly projecting gunwales found on various types of canoes by placing the side rails with their open, elastic-lined sides towards or away from each other, respectively.

The fastening of the side rails to the gunwales of the canoe is accomplished in a most careful manner. The elastic lining eliminates the danger of damaging the gunwales at normal loads and, more importantly, no holes need be drilled in the hull or the gunwales of the canoe to hold the motor mount in place.

The motor mount according to the invention has, furthermore, the motor mounting piece fastened to one of the crossbars so that said piece can be placed either side of the canoe and not directly behind the stern. By placing the motor on the side, no extra long tiller handle is necessary, and the motor can be comfortably controlled from the stern seat.

The motor mount according to this invention also allows a continuous variation or adjustment in the angle of the motor mounting piece itself, that is, vertically or in any desired angle forwards of sternwards in order to obtain optimum motor effect, for example, because of the load distribution in the canoe.

These advantages and other features of the motor mount according to this invention are illustrated in the following drawing of a suitable design that is merely exemplary and will become apparent in the below description.

FIG. 1 shows the motor mount in its folded position as viewed from above,

FIG. 2 shows the folded motor mount from below,

FIG. 3 shows a schematic, perspective drawing of the motor mount as it is when unfolded and affixed to the gunwales of a canoe, the embodiment of which is represented by the broken lines, and FIG. 4 shows a sectional view of the clamping device.

In the figures, reference numeral 10 represents a foldable framework comprising two side rails in the form of U-shaped extrusions or beams 12,14 and two crosspieces in the form of crossbars or pipes 16,18.

An elastic lining 20, for example, of sponge rubber, is attached to the inside surfaces of the U-shaped rails.

At one end of one of the crossbars 16 there is a motor mounting piece 22 attached onto which an outboard motor can be mounted in the usual manner. It is assumed that the motor is preferably an electric outboard motor, but internal combustion motors may also be used.

In order to fold, unfold and adjust the framework to fit the canoe 24 in question, for example having the form represented by the broken lines in FIG. 3 and having, as shown in FIG. 4, an outwardly projecting gunwale 26, the U-shaped rails 12,14 are provided with rotatable clamping devices 28,30,32,34 for holding crossbars 16,18 so that said bars can be slid through the devices or clamped in them, respectively.

Since the clamping devices are all alike, only one is illustrated herein, namely 28 in FIG. 4. This device is a piece of square extrusion with holes 36 in the two opposing, vertical sides for holding the crossbar 18. In said vertical sides there are also slots 38 running from one end of the extrusion to holes 36, dividing the extrusion into an upper half 40 and a lower half 42 that can be pressed together to fix bar 18 in the device when necessary.

At each end of each U-shaped rail's upper flange there is a screw 44 that projects up through the lower part 42 and the upper part 40 of the clamping device so that the device can rotate around said screw. The upper part of the screw 44 is provided with a clamping nut in the form of a knob 46, the tightening of which results in the fixing of bar 18 in the clamping device.

To affix the framework to a canoe 24, all the knobs 46 are loosened so that the framework can be unfolded and adjusted to the shape that best fits the gunwales 26 of the canoe at the desired place, as is illustrated in FIG. 3. In this position the U-shaped side rails 12,14, each with an elastic lining 20, fit against and around the gunwales 26. The knobs 46 on one side are first tightened to fix the crossbars and the one side rail in place. The U-shaped rails are then pressed against the gunwales, compressing the elastic linings, to achieve the desired amount of friction, and the remaining two knobs are tightened. If the motor mounting piece 22 was not given the proper angle when the knobs on one side were tightened, it can be readjusted at any time.

The above description and the drawing illustrate that the motor mount according to this invention has the advantages stated in the introduction.

What I claim is:

1. A motor mount designed to be affixed to the outwardly or inwardly projecting gunwales of a wide variety of canoes, comprising two side rails and two crosspieces that together form a framework that can be affixed to a canoe wherein the side rails comprise two U-shaped members of equal length provided with elastic linings that can be attached to the outside of outwardly projecting gunwales or to the inside of inwardly projecting gunwales; each U-shaped side rail having at each end portion a rotatable clamping device having its axis of rotation perpendicular to the top and bottom flanges of the U-shaped side rails; the crosspieces consisting of front and rear members that can be slid through and/or clamped tight in said clamping devices, so that the U-shaped side rails and the crosspieces form a frame-work that has two opposite sides with the same length between their respective clamping devices and two sides formed by the crosspieces between the clamping devices that can be freely varied in length by sliding said crosspieces through said clamping devices; the end of one of the crosspieces being located outside the nearest clamping device and carrying a motor mounting on which to mount a propulsion motor, said framework being foldable together so that the U-shaped side rails and the crosspieces lie close to each other.

* * * * *